US005345622A

United States Patent [19]

Plone

[11] Patent Number: 5,345,622

[45] Date of Patent: Sep. 13, 1994

[54] METHOD OF FABRICATING INFLATABLE BATHING TUB AND ASSOCIATED SUPPORT APPARATUS

[76] Inventor: Clifford Plone, 1619 W. Coventry Pl., Palmdale, Calif. 93551

[21] Appl. No.: 14,693

[22] Filed: Feb. 8, 1993

[51] Int. Cl.[5] ..... A47K 3/06

[52] U.S. Cl. ..... 4/588; 4/585; 4/587; 5/449; 5/455

[58] Field of Search ..... 4/585, 586, 587, 588, 4/589, 592, 580, DIG. 18, 506, 584; 5/449, 455; 128/DIG. 932, 191

[56] References Cited

U.S. PATENT DOCUMENTS

| | | | |
|---|---|---|---|
| 573,625 | 12/1896 | Ruffner . | |
| 821,230 | 5/1906 | Fowler . | |
| 1,444,487 | 2/1923 | Volters | 4/587 |
| 2,567,514 | 9/1951 | Hoffman | 4/587 |
| 2,689,812 | 9/1954 | Mollica et al. | 154/85 |
| 2,713,746 | 7/1955 | Haugh | 5/932 |
| 2,728,920 | 1/1956 | Hylton et al. | 4/177 |
| 3,089,153 | 5/1963 | Bosc | 5/455 |
| 3,513,489 | 5/1970 | Miller et al. | 5/98 |
| 3,710,791 | 1/1973 | Deaton | 128/191 |
| 3,931,652 | 1/1976 | Navarra | 4/187 |
| 4,023,220 | 5/1977 | Younker | 4/177 |
| 4,051,563 | 10/1977 | Clarke, Jr. | 4/173 |
| 4,442,838 | 4/1984 | Samson et al. | 4/585 |
| 4,602,393 | 7/1986 | Fiveash | 4/580 |
| 4,785,486 | 11/1988 | Viesturs | 4/585 |
| 4,858,755 | 8/1989 | Kuivanen | 206/45.31 |
| 4,964,183 | 10/1990 | LaForce, Jr. | 4/588 |
| 5,144,703 | 9/1992 | Maire | 4/580 |

FOREIGN PATENT DOCUMENTS

| | | | |
|---|---|---|---|
| 0935752 | 10/1955 | Netherlands | 4/585 |

*Primary Examiner*—Henry J. Recla
*Assistant Examiner*—Gregory M. Vidovich
*Attorney, Agent, or Firm*—William W. Haefliger

[57] ABSTRACT

The method of forming an inflatable tub that includes shaping inner and outer plastic sheets to form tub upright side walls and end walls, and corners between the walls; bonding the sheets at each wall to form panels bonded together at certain locations, and introducing inflation fluid between the sheet to space them apart from one another at other locations about the panels by inflation pressure, whereby each wall defines upright inner and outer sides with substantially uniform maximum spacing between the inner and outer sides along the inflated walls between the corners; and providing the tub with a bottom wall defined by bottom plastic sheet structure connected to lowermost extents of the side and end walls and the corners.

2 Claims, 6 Drawing Sheets

FIG. 13.
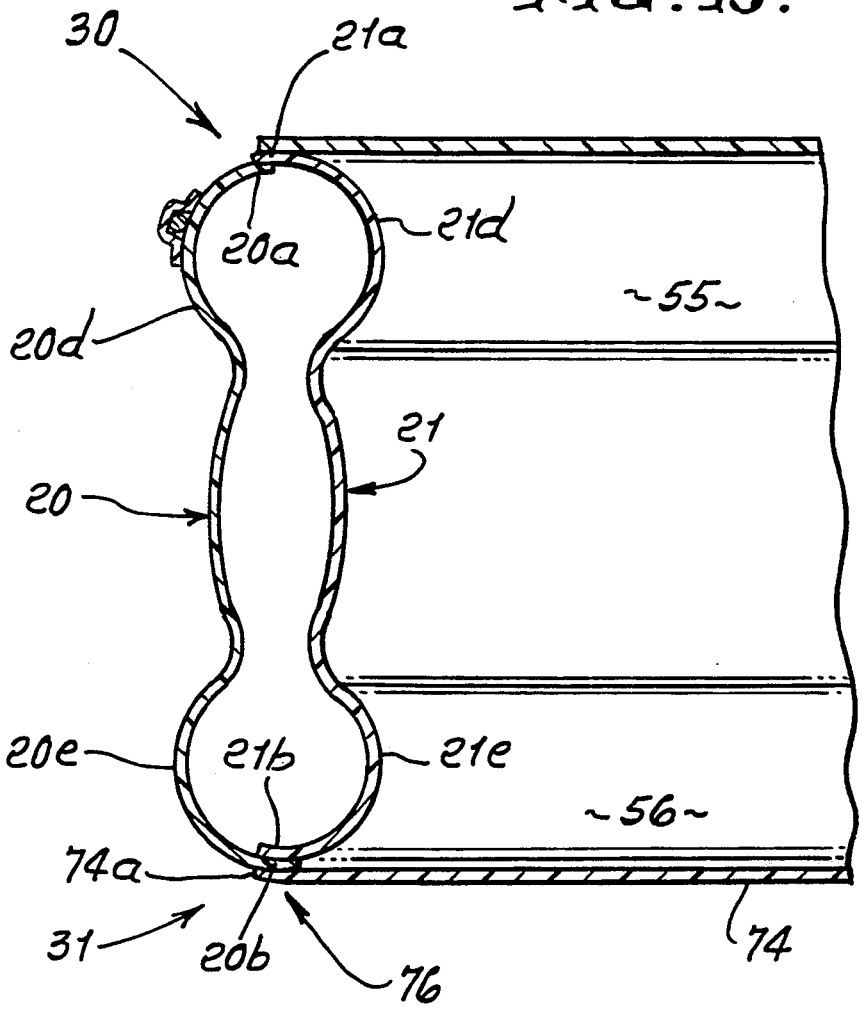
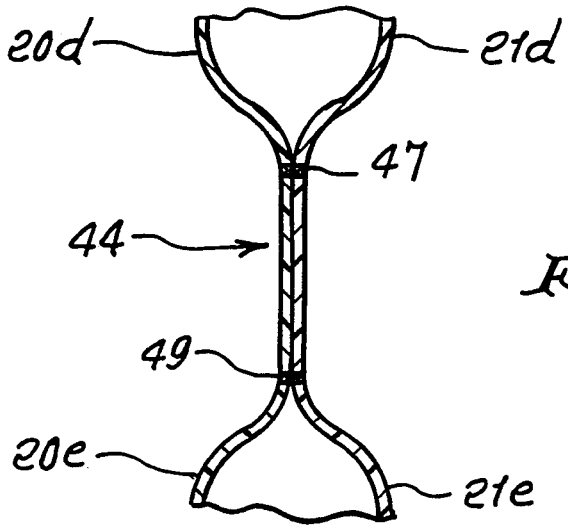
FIG. 12.

FIG. 14.
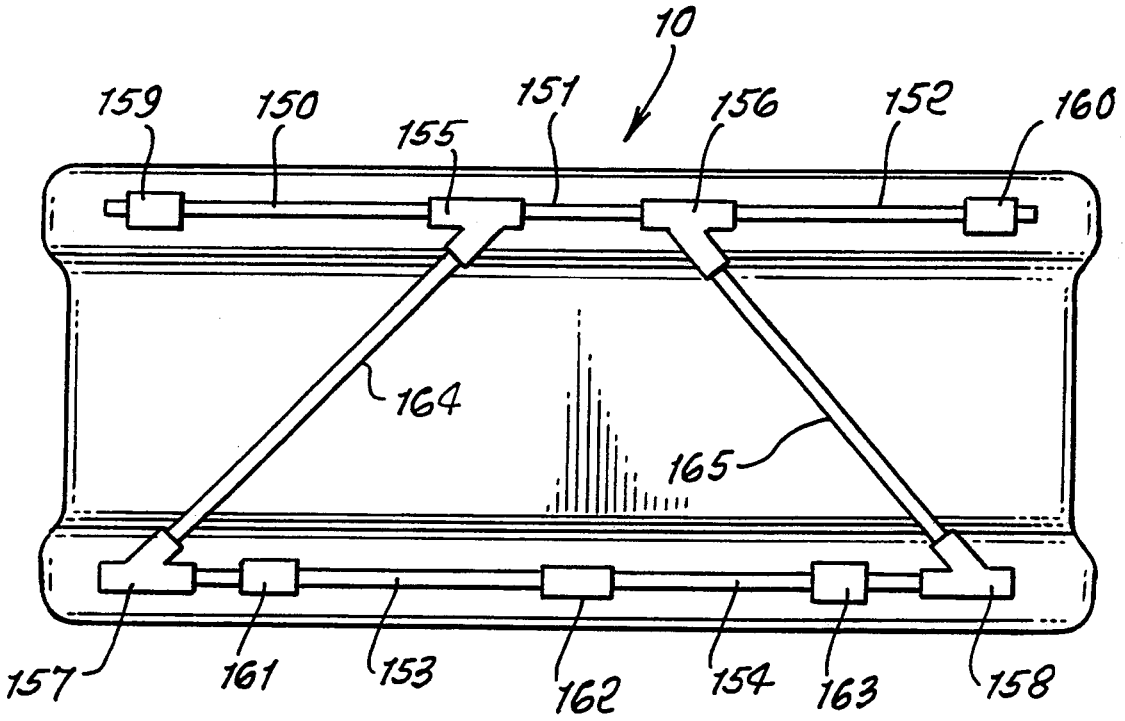
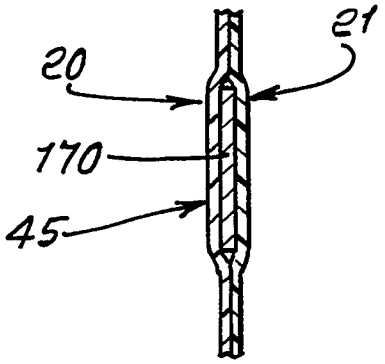
FIG. 15.

METHOD OF FABRICATING INFLATABLE BATHING TUB AND ASSOCIATED SUPPORT APPARATUS

BACKGROUND OF THE INVENTION

This application relates generally to inflatable objects, and more particularly to a method of forming inflatable bathing tub apparatus, usable for example to safely bathe infants in standard bath tubs; also, the completed tub has other uses.

There is continuing need for improved bathing means for infants, and especially to receptacles for safe bathing of infants.

Standard bath tubs can be dangerous in that the infant's body and head can inadvertently strike hard ceramic or other solid surfaces; and plastic bassinets can be dangerous in that they can collapse, or the infant can roll off high surfaces on the bassinet. While inflatable bathtubs are known, as exemplified in U.S. Pat. No. 573,625, they do not embody the unusual advantages in simplicity and effectiveness of tub formation, tub construction, modes of operation, and the operating results as now are afforded by the present invention.

SUMMARY OF THE INVENTION

It is a major object of the invention to provide an unusually advantageous method of forming an inflatable and highly useful bathing tub apparatus meeting the above needs, and embodying the exceptional advantages in fabrication, construction, modes of operation and results, as referred to. Basically, the method of forming or fabricating the unusually advantageous tub includes:

a) shaping inner and outer plastic sheets to form tub upright side walls and end walls, and corners between said walls, b) bonding the sheets at each wall to form panels bonded together at certain locations, and introducing inflation fluid between the sheet to space them apart from one another at other locations about the panels by inflation pressure, whereby each wall defines upright inner and outer sides with substantially uniform maximum spacing between the inner and outer sides along the inflated walls between the corners, c) and providing the tub with a bottom wall defined by bottom plastic sheet means connected to lowermost extents of the side and end walls and the corners.

As will appear, the tub, when inflated, may fit between side walls of a standard bathtub, and yet protect a bathing infant from contact or impact with such side walls or other walls of the standard tub.

Another object is to provide for merging of the inner and outer plastic sheet walls at an upper lengthwise extending rim of the inflated tub, bonding of the inner and outer sheets is effected to space said panels below the rim so that the wall is inflated immediately below the rim and lengthwise continuously along and below the rim, and at vertical location, to provide self-supporting tub walls, effective when water is filled into the tub.

A further object is to provide an inflated tub corner construction, as for each of four corners, and wherein the plastic sheets, as referred to, extend also at each corner, and at which the inner and outer sheets are bonded together at certain bond locations and spaced from one another at other locations by inflation air pressure, and the certain bond locations at the corners are spaced below the levels of upper rims defined by the side and end walls, the rims merging at the corners.

In this regard, the side and end walls, and corners, are typically inflated along the entire wall lengths and at the corners at upper locations immediately below the rims whereby all of the bond locations are located below the levels of the upper locations.

Yet another object is to provide a mattress engaged against the tub bottom wall, the mattress formed to comprise upper and lower plastic sheets bonded together at certain bond locations, and vertically spaced from one another at other locations by inflating gas pressure to provide cushioning. The mattress may be downwardly engaged against the bottom wall of the tub, the mattress having peripheral extents fitted between the tub bottom wall and lowermost inflated extents of the side and end walls. Alternatively, the mattress may have an upper side upwardly engaged against the bottom wall of the tub, whereby the bottom wall of the tub is upwardly supported and cushioned by the external mattress. Further, the inflated mattress may be formed to define an upwardly bulging pillow, and upwardly bulging lengthwise elongated zones extending away from the pillow, the bonds located between the pillow and the elongated bulging zones, and also between the bulge zones.

Other objects include the provision of support rods extending along the sides and ends of the inflated tub, such rods being removable to allow collapse (deflation), folding, and easy storage of the tub; the provision of mattress support or stability rods; and the provision of an inflatable lid for the tub apparatus; and the provision of a niche in an end wall for user's leg or arm support, as the leg or arm is submerged in tub water.

A further object is to provide an inflated tub comprising:

a) plastic sheets forming tub upright side walls and end walls, and corners between the walls, b) the sheets at each wall including inner and outer sheets bonded together at certain bond locations and spaced from one another at other locations by inflation gas pressure, whereby each wall defines upright inner and outer sides with substantially uniform maximum spacing between the inner and outer sides over the wall extent between contiguous corners, c) and the tub having a bottom wall defined by bottom plastic sheet means connected to lowermost extents of the side and end walls and the corners.

As will appear, the inner and outer sheets of each wall merge at an upper rim which extends lengthwise, and the certain bond locations are spaced below the rim so that the wall is inflated immediately below the rim and lengthwise continuously along and below the rim. Further, the side and end walls and corners are inflated along the entire wall lengths and at the corners at upper locations immediately below the rims whereby all of the bond locations are below the levels of the upper locations.

Yet another object is to provide an inflated mattress comprising upper and lower plastic sheets bonded together at certain bond locations, and vertically spaced from one another at other locations by inflating gas pressure to provide cushioning. The mattress may be located above or below the tub bottom wall as referred to above.

These and other objects and advantages of the invention, as well as the details of an illustrative embodiment, will be more fully understood from the following specification and drawings, in which:

DRAWING DESCRIPTION

FIG. 12 is a vertical section taken on lines 12—12 of FIG. 11, and after inflation and attachment of a bottom wall;

FIG. 13 is a vertical section taken on lines 13—13 of FIG. 11, and after inflation and attachment of a bottom wall;

FIG. 14 shows the tub of the invention supported by frame structure; and

FIG. 15 is a section showing a shear wall in the tub.

DETAILED DESCRIPTION

Referring first to FIGS. 1–4, they show a tub 10 to have air inflated side walls 11 and 12, end walls 13 and 14, and a bottom wall 15.

Figure 11:
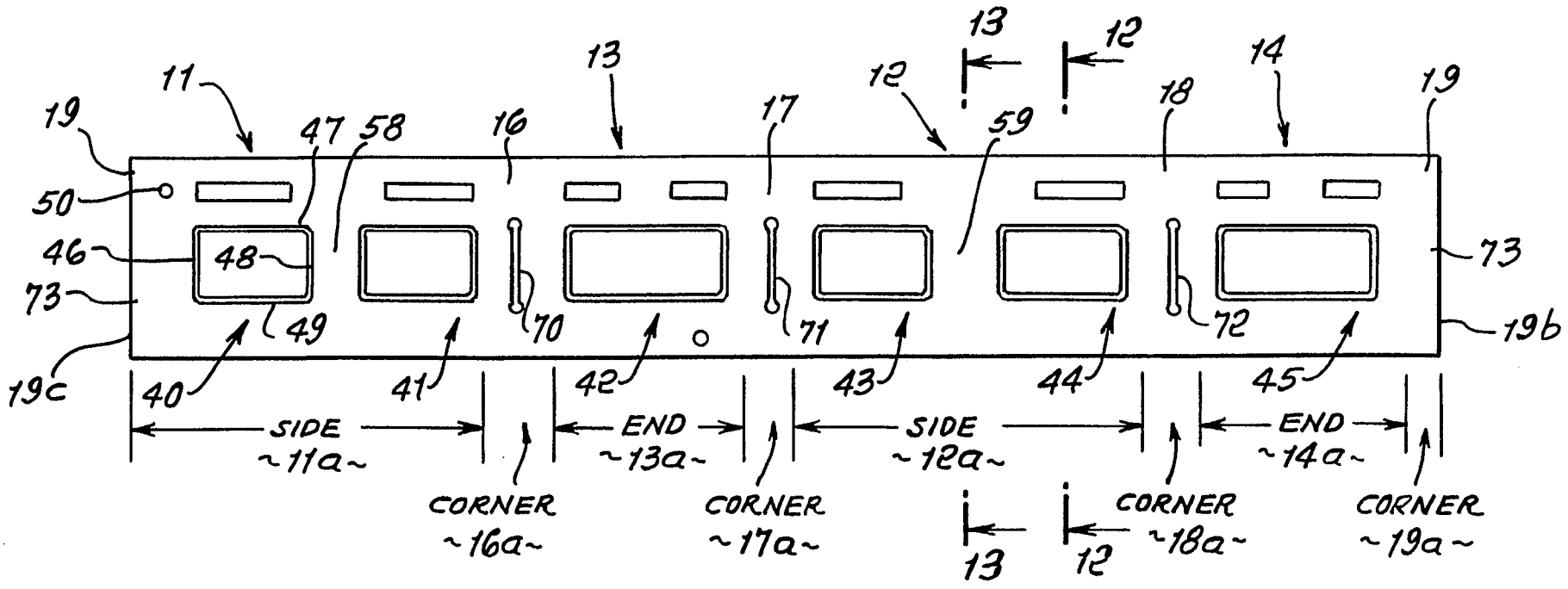
FIG. 11 is an elevation showing tub side wall structure during its formation and assembly.

The method of forming the tub side walls and end walls is, for example, illustrated in FIGS. 11–13. As shown, two like or closely similar plastic sheets 20 and 21, shown in registered elevation, are shaped to form the upright side walls and end walls, and corners 16–19 between such walls. These wall and corner regions are indicated in flat, planar form in FIG. 11; and their lengths are approximately indicated at 11*a*, 12*a*, 13*a*, 14*a*, and 16–19. The planar sheets 20 and 21 are elongated to form the entire wall. Elongated upper rim 30 is defined by bonding together of upper edges 20*a* and 21*a* of the sheets, in overlapping relation. See FIGS. 12 and 13. Similarly, elongated lower rim 31 is defined by bonding together lower edges 20*b* and 21*b* of the sheets, in overlapping relation.

During fabrication, the sheets 20 and 21 are also locally bonded together at each of the walls 11–14, to form panels, or panel-like zones, indicated at 40 and 41 at side wall 11, 42 at end wall 13, 43 and 44 at side wall 12, and at 45 at end wall 14. Such panels or zones are shown as generally rectangular, with local bonded legs at 46–49 along the periphery of each panel. The panels act to stiffen the walls 11–14; and they are spaced apart as shown so that, when inflation air is introduced between the sheets, as via inlet 50, the tub will take the form generally as shown in FIGS. 1–6, and specifically as seen in FIGS. 12 and 13. Note in the latter that the sheets are spaced apart, i.e., bulge inwardly and outwardly at 21*d* and 20*d* above the panels, and also bulge inwardly and outwardly at 21*e* and 20*e*, below the panels, providing upper bulge continuity all around the tub, to provide an upper, horizontal, looping tube 55; and lower bulge continuity all around the tub to provide a lower, horizontal, looping tube 56.

This also provides for inflated vertical "legs" between such looping tubes, as at corner locations 16–19, and also at vertical location 58 between side panels 40 and 41, and at vertical location 59 between side panels 43 and 44. Six such legs are thereby provided, acting to provide vertical stability at the corners and sides of the tub. For further stability and for preventing excessive bulging at the corners, local vertical or linear bonds between the sheets are provided at 70–72 (corners 16–18); and an edge overlap bond is provided at 73 at corner 19 (i.e., edge 19*b* overlaps and is bonded to edge 19*c*) during fabrication, and between the top and bottom of the sheets, as seen in FIG. 11.

FIGS. 12 and 13 also show bonding at 76 of the periphery 74*a* or bottom plastic sheet 74 to the lower rim extents of the sheets 20 and 21.

It will be understood that for simplicity in FIGS. 3–6, the side and end walls between the looping tubes 55 and 56 are shown as a single, plastic sheet.

Also provided is a mattress 79 engaged against the bottom wall, the mattress formed to comprise upper and lower plastic sheets bonded together at certain bond locations, and vertically spaced from one another at other locations by inflating gas pressure to provide cushioning. See for example mattress upper and lower plastic sheets 80 and 81 bonded together at rectangular peripheral locations 82–85, to be fitted or tucked between the tub bottom wall 74 and lowermost inflated extents of the tub side and end walls. See FIGS. 3 and 4. Bond location 86–89 between sheets 80 and 81 extend endwise of the mattress to define bulging parallel cushion regions 90–94 (see FIG. 2); and also a "pillow" inflated region 95 extending transversely at one end of the mattress. Note that bond locations 86–89 terminate at transverse bond 96 between cushions 90–94 and the pillow.

Figure 4:
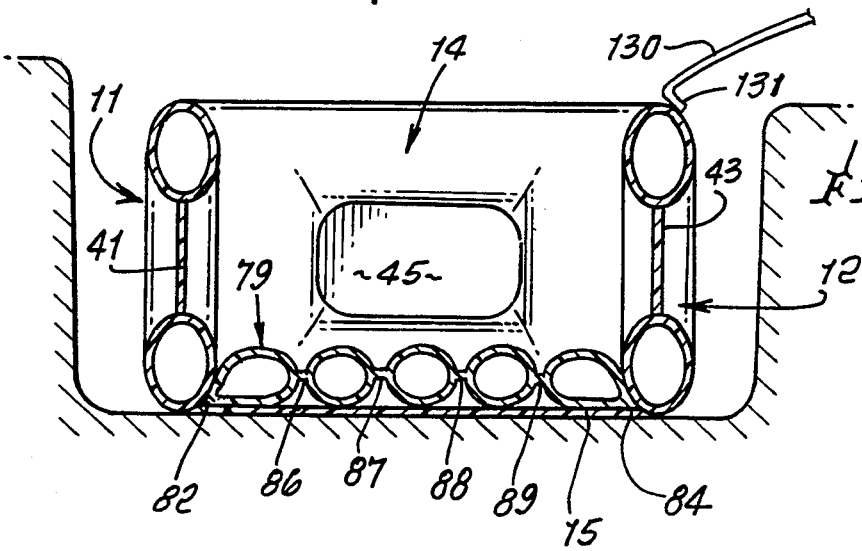
FIG. 4 is a vertical section taken on lines 4—4 of FIG. 3.
Figure 5:
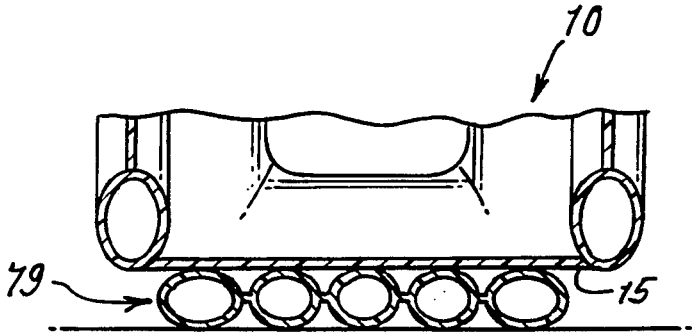
FIG. 5 is a fragmentary elevation, like that of FIG. 4, but showing a mattress or pad located beneath the tub, in supporting relation.

FIG. 4 shows the mattress lying above bottom sheet 74; whereas, FIG. 5 shows the mattress supporting the bottom sheet. In either event, the infant placed in the tub is cushioned sidewardly and below. In FIG. 5, the mattress is not soiled by tub soapy water.

Figure 1:
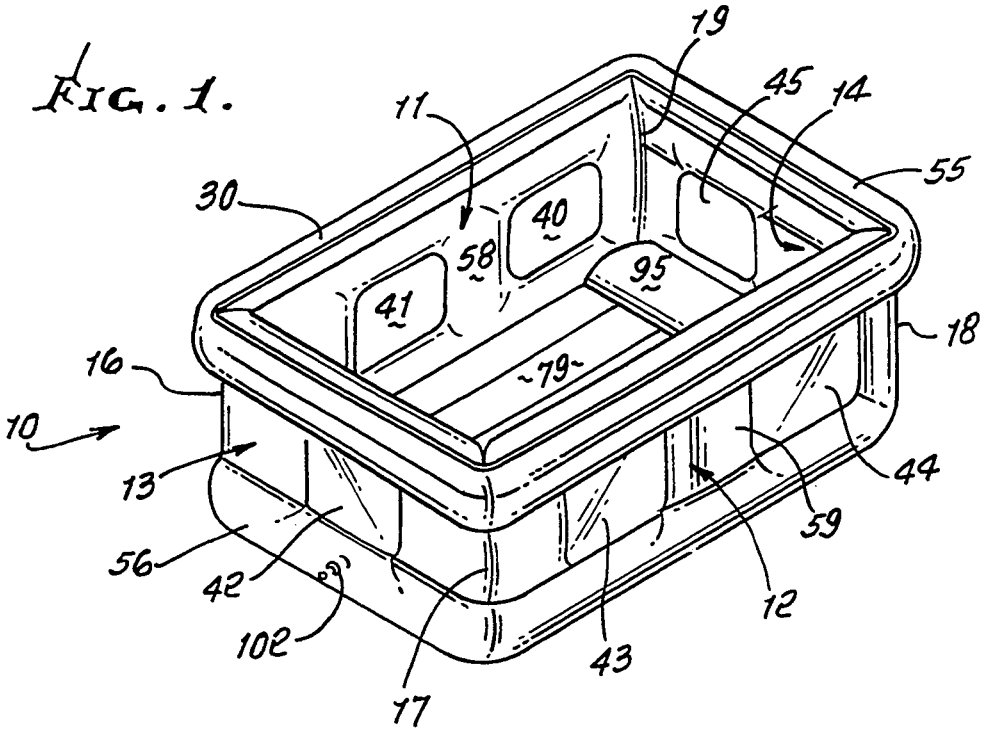
FIG. 1 is a perspective view showing an inflated tub incorporating the invention.
Figure 2:
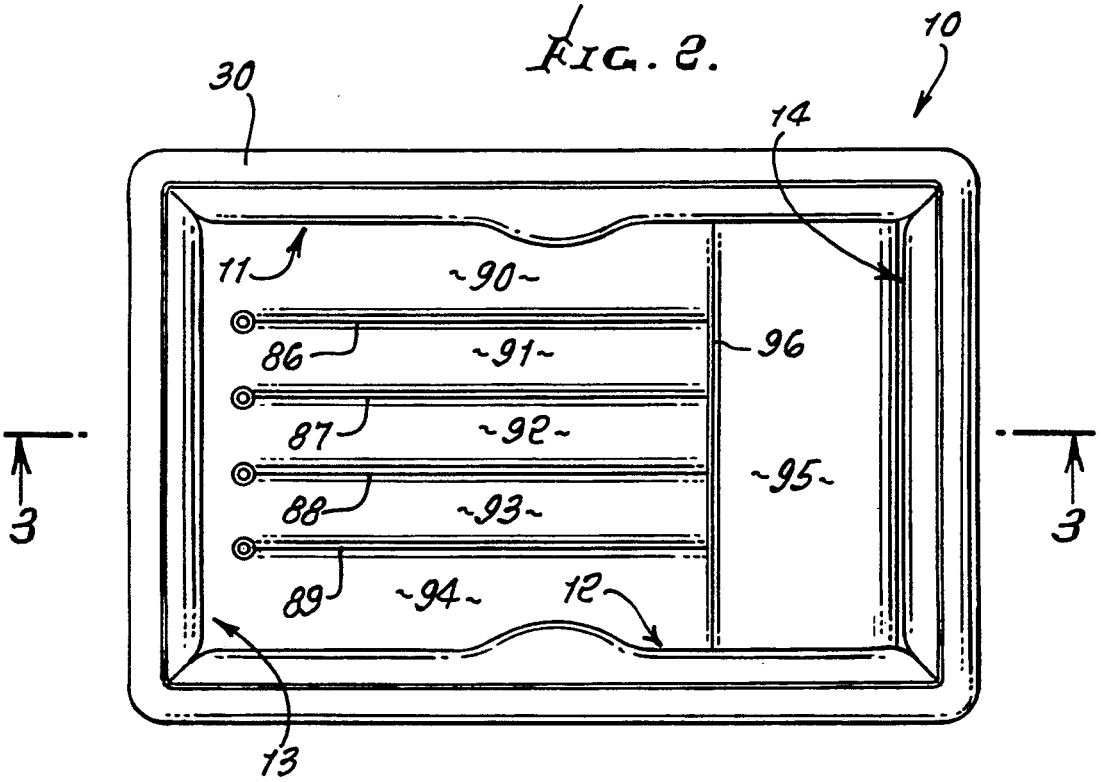
FIG. 2 is a top plan view of the FIG. 1 tub.
Figure 3:
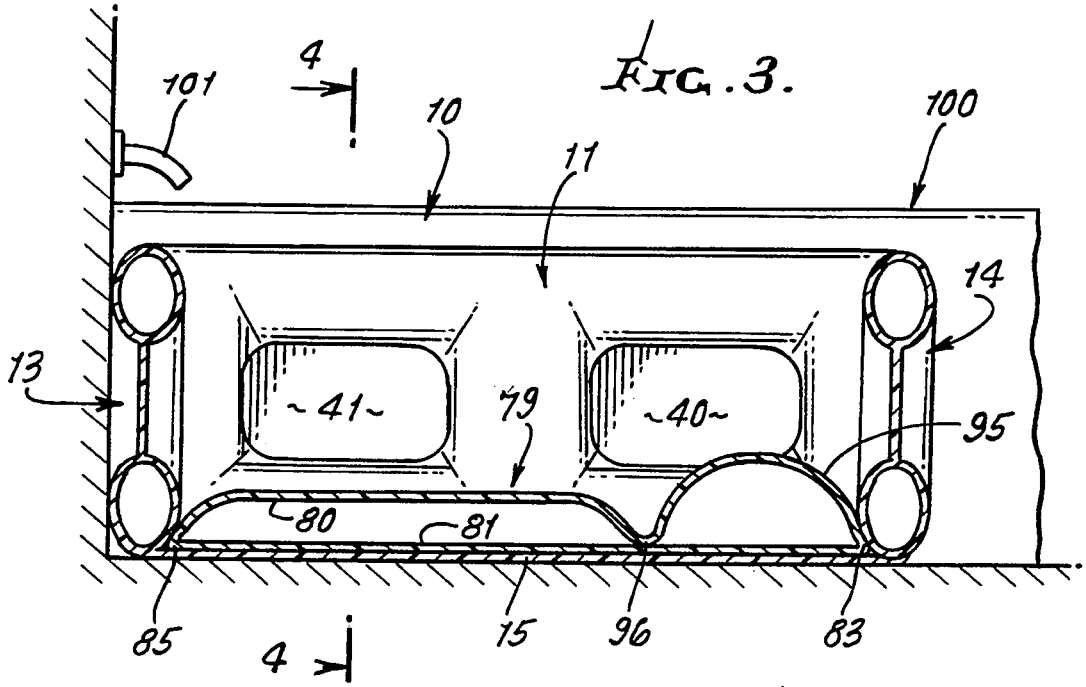
FIG. 3 is a vertical section taken on lines 3—3 of FIG. 2.

FIG. 3 shows the inflated tub placed in a metallic or other conventional bathtub 100, having a water fill spigot 101 extending above the tub 10, to fill same. A drain for tub 10 is provided at 102 in FIG. 1.

Figure 6:
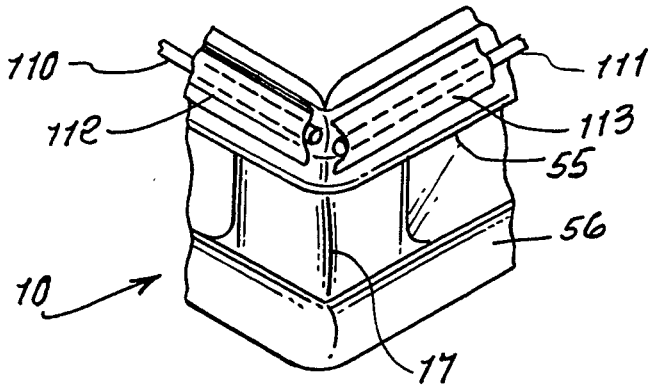
FIG. 6 is a corner perspective view showing use of upper stiffener end means.

FIG. 6 shows wall stiffener rods 110 and 111 removably received endwise in looping holders 112 and 113 attached to the side and end walls of the tub, adjacent upper tube 55.

Figure 7:
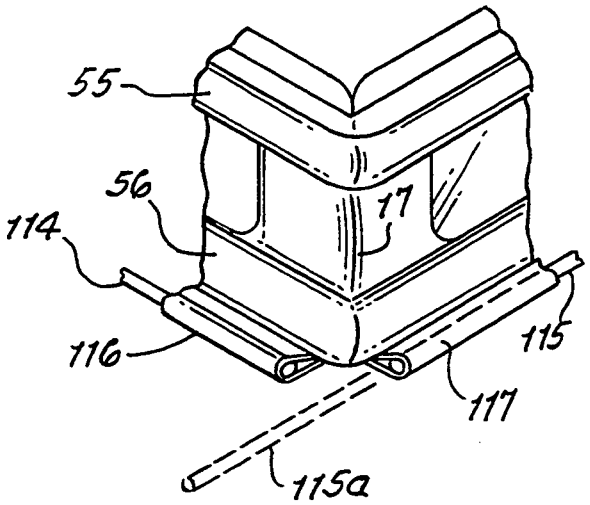
FIG. 7 is a view like FIG. 6 showing use of lower stiffener end means with capability to act as lateral supports.

FIG. 7 shows similar wall stiffener rods 114 and 115 removably received endwise in holders 116 and 117 attached to the side and end walls of the tub, i.e., adjacent lower tube 56. Lower rods 115 may project endwise, as at 115*a*, to engage the floor or other surface and prevent over-turn of the tub.

Figure 10:
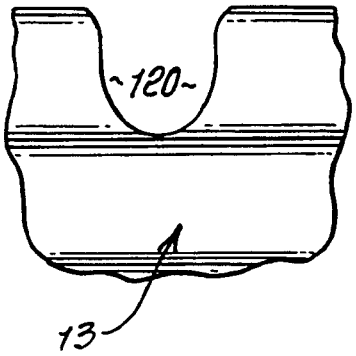
FIG. 10 is an end elevation taken on lines 10—10 of FIG. 9.
Figure 9:
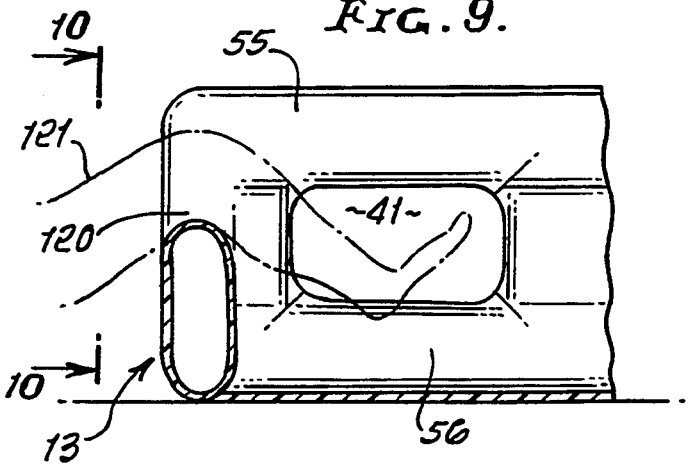
FIG. 9 shows use of a modified tub.

FIGS. 9 and 10 show a U-shaped niche or opening 120 in end wall 13, for reception of the bather's leg or arm 121, as during submerging (partial bathing) of that leg or arm. Wall 13 is of less height at the niche.

Figure 8:
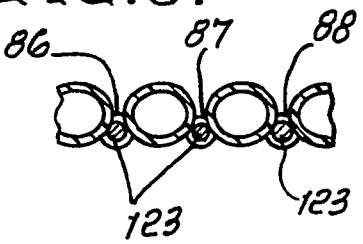
FIG. 8 is a fragmentary elevation taken in section to show support rods co-acting with a mattress to be used in the tub apparatus.

FIG. 8 shows support rods 123 extending below the bond locations 86–89 to provide additional mattress support.

FIG. 4 also shows an optional protective cover sheet (plastic) 130 hingedly attached to the tub, as at 131.

FIG. 14 shows a tub 10 of the invention, as described above, with supporting frame structure at the tub sides. See PVC truss rods 150, 151, 152, 153, and 154 that extend horizontally, interconnection tees 155–158, and holders 159–163 attached to the tub walls and receiving the rods. Diagonal rods 164 and 165 extend between tees, as shown, to provide reinforcement and support.

FIG. 15 shows a shear wall or sub-panel 170, which is relatively stiff and is carried between sheets 20 and 21, as at panel location 45, or other panel locations. This adds to wall stability and resists bulging. Sub-panel 170 may be located at the sheet exterior and bonded thereto.

I claim:

1. An inflatable tub, comprising, in combination:

a) plastic sheets forming tub upright side walls and end walls, and corners between said walls, b) the sheets at each wall including inner and outer sheets bonded together at certain bond locations and spaced from one another at other locations by inflation gas pressure, whereby each wall defines upright inner and outer sides with substantially uniform maximum spacing between said inner and outer sides over the wall extent between contiguous corners, and panels in said walls, at which the sheets are bonded together, c) and the tub having a bottom wall defined by bottom plastic sheet means connected to lowermost extents of said side and end walls and said corners, d) said inner and outer sheets of each wall merging at an upper rim which extends lengthwise, and said certain bond locations are spaced below said rim so that the walls are inflated immediately below the rim and lengthwise continuously along and below said rim to form an upper tube extending over said panels, and also merging said inner and outer sheets of each wall at vertical locations to form inflated vertical legs at said corners, all of said inflated legs extending above and below the levels of said panels, to communicate with said upper tube, to provide self-supporting tub walls, effective when water is filled into the tub, said legs at said corners separated by said panels, the walls also inflated lengthwise continuously at and along the bottoms thereof to form a lower, continuous tube, which is everywhere spaced below the levels of said panels, and which communicates with all of said legs, e) the inner and outer sheets locally bonded together at tub corners to form narrow, vertically elongated, non-inflated, stabilizing, vertical bond regions at and medially of said inflated legs, whereby inflated corner legs extend downwardly at one leg from said tube and then separate into two legs at the levels of successive panels at said sides and ends of the tub, said two legs merging below said vertical bond region to form a single inflated leg that communicates with said lower tube, f) said sheets at each corner includes inner and outer sheets bonded together at certain bond locations and spaced from one another at other locations by inflation air pressure, and including locating said certain bond locations at the corners to be spaced below the levels of upper rims defined by said side and end walls, said rims merging at said corners, g) the side and end walls and corners being inflated along the entire wall lengths and at said corners at upper locations immediately below said rims whereby all of said bond locations are located below the levels of said upper locations, h) providing a mattress engaged against said bottom wall, the mattress formed to comprise upper and lower plastic sheets bonded together at certain bond locations, and vertically spaced from one another at other locations by inflating gas pressure to provide cushioning, the mattress having a periphery that is fitted between the tub bottom wall and lowermost inflated extents of the tub side and end walls, i) the mattress defining an upwardly bulging pillow, and upwardly bulging lengthwise elongated zones extending away from the pillow, and bonds between said pillow and said elongated bulging zones, and also between said bulging zones, j) providing support rods extending along the tub walls and supported by said tub walls, k) and providing a reinforcement rod structure externally of said walls, and including diagonally extending rods connected to horizontally extending rods, to form a truss structure and including means for connecting said reinforcement rod structure to said walls.

2. The method of forming an inflatable tub that includes:

a) shaping inner and outer plastic sheets to form tub upright side walls and end walls, and corners between said walls, b) bonding the sheets at each wall to form panels bonded together at certain locations, and introducing inflation fluid between the sheets to space the sheets apart from one another at other locations about the panels by inflation pressure, whereby each wall defines upright inner and outer sides with substantially uniform maximum spacing between said inner and outer sides along the inflated walls between said corners, c) providing the tub with a bottom wall defined by bottom plastic sheet means connected to lowermost extents of said side and end walls and said corners, d) merging said inner and outer sheets of each wall at an upper rim which extends lengthwise over said bonded panels, and said bonding is effected to space all of said panels below said rim so that each wall is inflated immediately below the rim and lengthwise continuously along and below said rim to define an upper tube extending over said panels, and also merging said inner and outer sheets of each wall at vertical locations to form inflated vertical legs at said corners, and extending all of said inflated legs above and below the levels of said panels, to communicate with said tube, to provide self-supporting tub walls effective when water is filled into the tub, e) locally bonding the inner and outer sheets together at tub corners to form narrow, vertically elongated, non-inflated, stabilizing, vertical bond regions at and medially of said inflated legs, whereby inflated corner legs extend downwardly at one leg from said tube and then separate into two legs at the levels of successive panels at said sides and ends of the tub, f) providing a mattress engaged against said bottom wall, the mattress formed to comprise upper and lower plastic sheets bonded together at certain bond locations, and vertically spaced from one another at other locations by inflating gas pressure to provide cushioning, g) downwardly engaging said mattress against said bottom wall of the tub, the mattress having a periphery, and fitting said periphery between said tub bottom wall and lowermost inflated extents of said side and end walls, h) forming the mattress to define an upwardly bulging pillow, and upwardly bulging lengthwise elongated zones extending away from the pillow, and locating bonds between said pillow and said elongated bulging zones, and also between said bulging zones, i) providing wall stiffening sub-panels at said panels for providing shear wall effects j) and providing a reinforcement rod structure externally of said walls, and including diagonally extending rods connected to horizontally extending rods, to form a truss structure to support said walls.

* * * * *